US007534121B2

(12) United States Patent
Chen

(10) Patent No.: US 7,534,121 B2
(45) Date of Patent: May 19, 2009

(54) SECURE SOCKET APPARATUS

(76) Inventor: Chin-Rong Chen, No.6, Sec. 1, Jinan Rd., Zhongzheng District, Taipei City 100 (TW)

( * ) Notice: Subject to any disclaimer, the term of this patent is extended or adjusted under 35 U.S.C. 154(b) by 0 days.

(21) Appl. No.: 11/896,926

(22) Filed: Sep. 6, 2007

(65) Prior Publication Data

US 2008/0274638 A1 Nov. 6, 2008

(51) Int. Cl.
*H01R 29/00* (2006.01)

(52) U.S. Cl. ..... 439/188

(58) Field of Classification Search ..... 439/188, 439/441; 361/78, 1, 93, 62, 85–86
See application file for complete search history.

(56) References Cited

U.S. PATENT DOCUMENTS 5,708,551 A * 1/1998 Bosatelli ..... 361/62
5,910,875 A * 6/1999 Tian et al. ..... 361/78
6,428,334 B1 * 8/2002 Skarie et al. ..... 439/188
6,552,888 B2 * 4/2003 Weinberger ..... 361/57

* cited by examiner

*Primary Examiner*—Jean F Duverne

(57) ABSTRACT

A secure socket apparatus includes a socket unit, a power supply unit and an overload-avoid unit. The socket unit includes at least one socket for receiving a plug of an electronic device. The power supply unit includes a switch module connected to the socket, at least one comparing element connected to the switch module and a sensing module connected to the switch module. The overload-avoiding unit is connected to the comparing element. The overload-avoiding unit can be connected to the mains so that electricity can be provided to the electronic device from the mains through the socket apparatus.

4 Claims, 4 Drawing Sheets

SECURE SOCKET APPARATUS

BACKGROUND OF INVENTION

1. Field of Invention

The present invention relates to a secure socket apparatus and, more particularly, to a socket apparatus for providing security by alarming on detecting an abnormal status in the supply of electricity and taking actions on detecting a dangerous status in the supply of electricity.

2. Related Prior Art

A conventional socket apparatus includes a socket unit and a circuit. The socket unit includes a plurality of sockets connected to the circuit in parallel. The circuit can be connected to the mains. An electronic device is connected to the mains through the conventional socket apparatus when a plug thereof is plugged in any of the sockets.

Electricity can be provided to the electronic device from the mains through the conventional socket apparatus. The conventional socket apparatus is however not equipped with any security device to avoid disasters. For example, short circuits might occur when the electronic device malfunctions. An overload occurs when too many electronic devices are connected to the conventional socket apparatus. A leak of electricity might occur when the socket apparatus is located in an excessively humid circumstance or soaked in water. A user might be electrically shocked in the case of such a leak. There are many concerns about the security in use of the conventional socket apparatus.

The present invention is therefore intended to obviate or at least alleviate the problems encountered in prior art.

SUMMARY OF INVENTION

The primary objective of the present invention is to provide a socket apparatus for providing security in use by alarming on detecting an abnormal status in the supply of electricity and taking actions on detecting a dangerous status in the supply of electricity.

To achieve the foregoing objective of the present invention, a secure socket apparatus includes a socket unit, a power supply unit and an overload-avoid unit. The socket unit includes at least one socket for receiving a plug of an electronic device. The power supply unit includes a switch module connected to the socket, at least one comparing element connected to the switch module and a sensing module connected to the switch module. The overload-avoiding unit is connected to the comparing element. The overload-avoiding unit can be connected to the mains so that electricity can be provided to the electronic device from the mains through the socket apparatus.

Other objectives, advantages and features of the present invention will become apparent from the following description referring to the attached drawings.

BRIEF DESCRIPTION OF DRAWINGS

The present invention will be described via detailed illustration of the preferred embodiment referring to the drawings.

DETAILED DESCRIPTION OF PREFERRED EMBODIMENT

Figure 1:
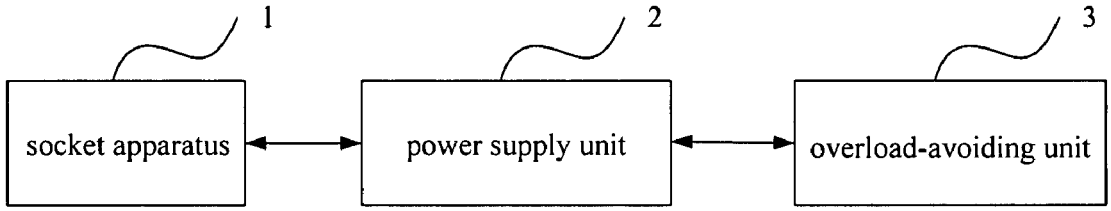
FIG. 1 is a block diagram of a socket apparatus according to the preferred embodiment of the present invention.

Referring to FIG. 1, a socket apparatus includes a socket unit 1, a power supply unit 2 connected to the socket unit 1 and an overload-avoiding unit 3 connected to the power supply unit 2 according to the preferred embodiment of the present invention.

Figure 2:
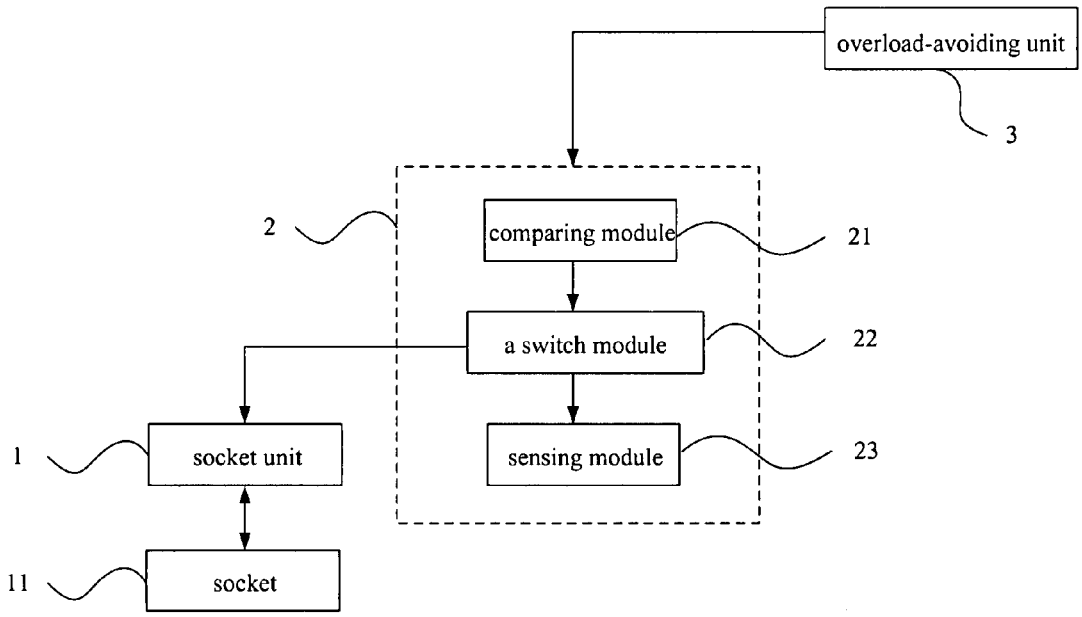
FIG. 2 is a more detailed block diagram of the socket apparatus shown in FIG. 1.
Figure 3:
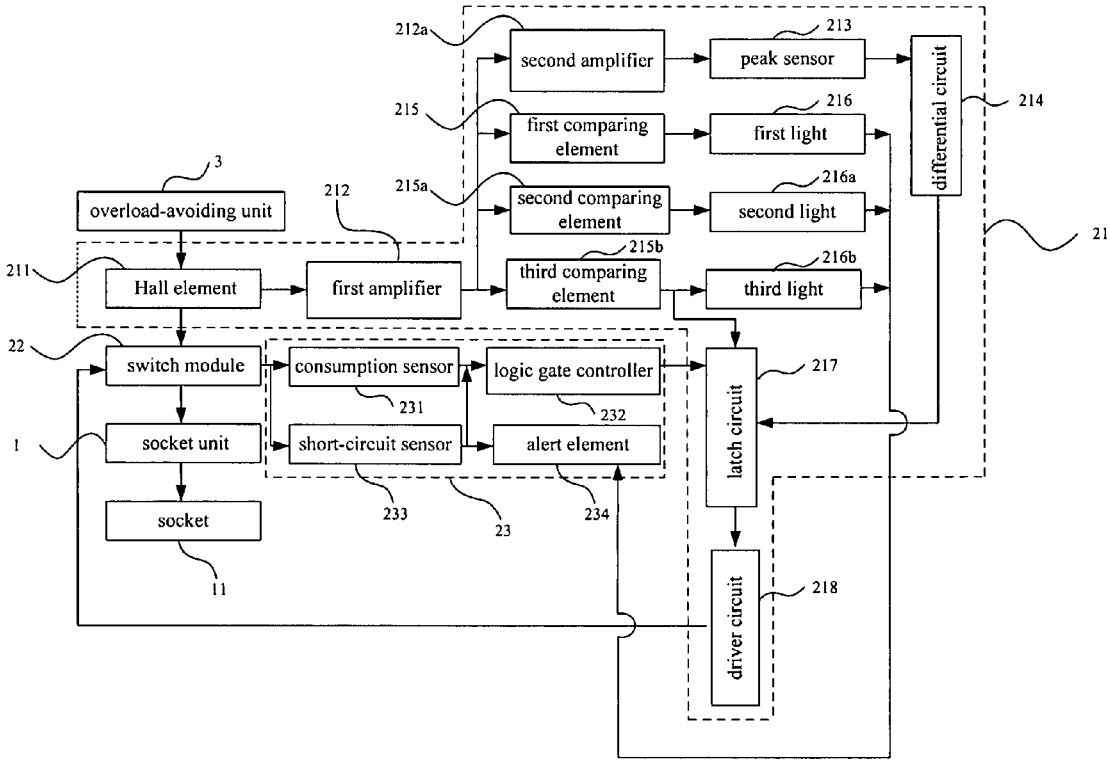
FIG. 3 is a more detailed block diagram of the socket apparatus shown in FIG. 2.
Figure 4:
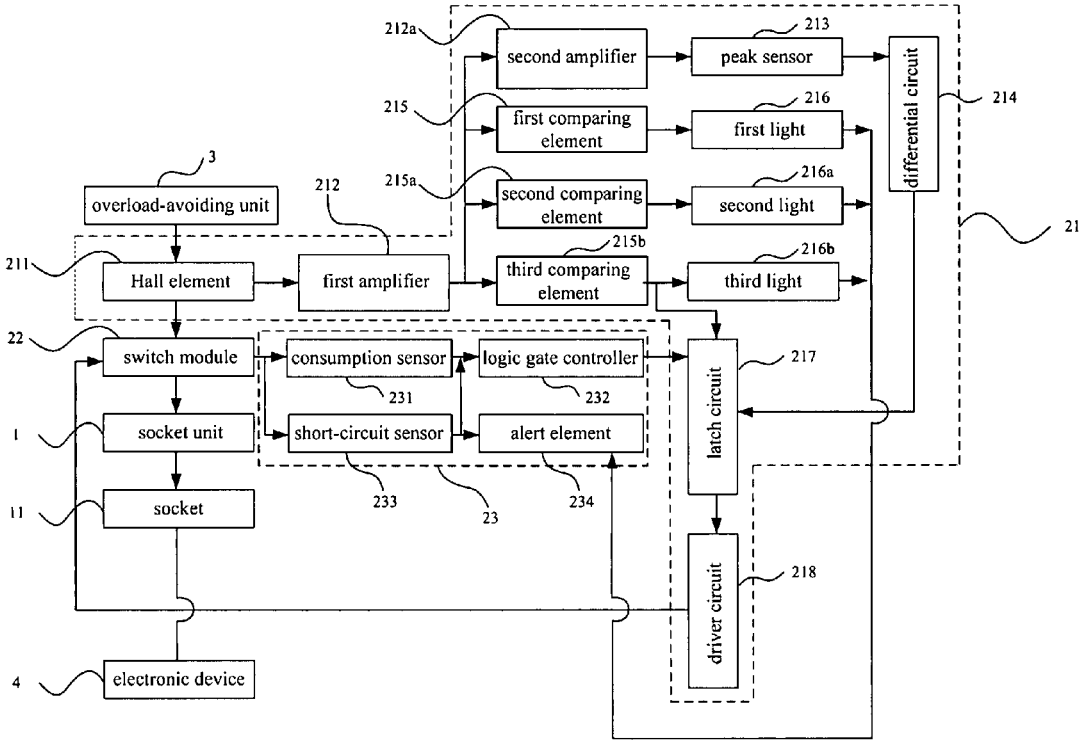
FIG. 4 is a block diagram of an electronic device connected to the socket apparatus shown in FIG. 3.

Referring to FIG. 2, the socket unit 1 includes at least one socket 11 for receiving a plug of an electronic device 4 (FIG. 4). The socket unit 1 generally includes a plurality of sockets 11 in parallel.

The power supply unit 2 includes a switch module 22 connected to the socket unit 1, a comparing module 21 connected to the switch module 22 and a sensing module 23 connected to the switch module 22.

The overload-avoiding unit 3 can be connected to the mains so that electricity can be provided to the socket apparatus from the mains.

Referring to 3, the comparing module 21 includes a Hall element 211 connected to the switch module 22, a first amplifier 212 connected to the Hall element 211, a second amplifier 212*a* connected to the first amplifier 212, a first comparing element 215 connected to the first amplifier 212, a second comparing element 215*a* connected to the first amplifier 212 and a third comparing element 215*b* connected to the first amplifier 212. A peak sensor 213 is connected to the second amplifier 212*a*. A differential circuit 214 is connected to the peak sensor 213. A latch circuit 217 is connected to the differential circuit 214 on one hand and connected to the third comparing element 215*b* on the other hand. A driver circuit 215 is connected to latch circuit 217 on one hand and connected to the switch element 22 on the other hand. A first light 216 is connected to the first comparing element 215. A second light 216*a* is connected to the second comparing element 215*a*. A third light 216*b* is connected to the third comparing element 215*b*.

The sensing module 23 includes a consumption sensor 231 connected to the switch module 22, a logic gate controller 232 connected to the consumption sensor 231, a short-circuit sensor 233 connected to the switch module 22 and an alert element 234 connected to the short-circuit sensor 233 on one hand and connected to the logic gate controller 232 on the other hand. The alert element 234 may be a speaker.

Referring to FIG. 4, a plug of an electronic device 4 is plugged in the socket 11 so that electricity is provided to the electronic device 4 from the mains through the socket apparatus when the overload-avoiding unit 3 is connected to the mains. The Hall element 211, the first and second amplifiers 212 and 212*a* and the first, second and third comparing elements 215, 215*a* and 215*b* are used to detect the power, compare the power with a plurality of pre-set values and judge.

The first comparing element 215 detects the power and compares the power with a pre-set value of 1000 watts. If the power is lower than 1000 watts, the first comparing element 215 turns on the first light 216 to emit green light for example. Thus, a user knows that the status of the supply of electricity is normal.

The second comparing element 215*a* detects the power and compares the power with a pre-set value of 1500 watts. If the power is between 1000 watts and 1500 watts, the second comparing element 215*a* turns on the second light 216*a* to emit orange light for example. Synchronously or alternatively, the second comparing element 215*a* may turn on the alert element 234 to provide beeps for example. Thus, the user knows that there is an overload in the supply of electricity, and can take actions to stop the overload.

When the electronic device 4 is short-circuited or soaked in water, the third comparing element 215*b* detects the power and compares the power with another pre-set value. If the power is 0 watt, the third comparing element 215*b* turns on the third light 216*b* to emit red light for example and instructs, via the latch circuit 217 and the driver circuit 218, the switch module 22 to cut the supply of electricity. Moreover, the switch module 22 causes the short-circuit sensor 233 to turn on the alert element 234 to provide beeps for example so that the user knows that there is a short circuit in the electronic device 4. The logic gate controller 232, the latch circuit 217, the driver circuit 218 and the switch module 22 work together to continue the detection to protect the user from electric shock because of leak.

When the socket 11 is not used, short-circuited, damped in a humid circumstance or soaked in water, the second amplifier 212*a* and the peak sensor 213 notifies the differential circuit 214 of the idle status of the socket 11. The differential circuit 214, the latch circuit 217 and the driver circuit 218 instruct the switch module 22 to cut the supply of electricity. The logic gate controller 232, the latch circuit 217, the driver circuit 218 and the switch module 22 work together to continue to detect whether the socket apparatus is in use. If the socket apparatus is in use, the switch module 22 retains the supply of electricity. If the socket apparatus is not in use, the switch module 22 continues to stop the supply of electricity. Hence, when the socket 11 is not in use, the user will not get electrically shocked should he touch the socket 11 by mistake.

The socket apparatus according to the present invention exhibits several advantages over the conventional socket apparatus discussed in the RELATED PRIOR ART. Firstly, it provides a selected color of light so that a user knows the status of the socket apparatus and can take actions if necessary. Secondly, it automatically takes necessary actions on detecting dangerous statuses in the socket apparatus.

The present invention has been described via the detailed illustration of the preferred embodiment. Those skilled in the art can derive variations from the preferred embodiment without departing from the scope of the present invention. Therefore, the preferred embodiment shall not limit the scope of the present invention defined in the claims.

The invention claimed is:

1. A secure socket apparatus comprising:

a socket unit comprising at least one socket for receiving a plug of an electronic device;

a power supply unit comprising a switch module connected to the socket, at least one comparing element connected to the switch module and a sensing module connected to the switch module; and an overload-avoiding unit connected to the comparing element, wherein the overload-avoiding unit can be connected to the mains so that electricity can be provided to the electronic device from the mains through the socket apparatus, wherein the comparing element comprises:

a Hall element connected to the switch module;

a first amplifier connected to the Hall element:

a second amplifier connected to the first amplifier;

a first comparing element connected to the first amplifier;

a second comparing element connected to the first amplifier;

a third comparing element connected to the first amplifier;

a peak sensor connected to the second amplifier;

a differential circuit connected to the peak sensor;

a latch circuit connected to the differential circuit on one hand and connected to the third comparing element on the other hand;

a driver circuit connected to latch circuit on one hand and connected to the switch element on the other hand;

a first light connected to the first comparing element;

a second light connected to the second comparing element; and a third light connected to the third comparing element.

2. The secure socket apparatus according to claim 1, wherein the first, second and third lights emit light of different colors.

3. A secure socket apparatus comprising:

a socket unit comprising at least one socket for receiving a plug of an electronic device;

a power supply unit comprising a switch module connected to the socket, at least one comparing element connected to the switch module and a sensing module connected to the switch module; and an overload-avoiding unit connected to the comparing element, wherein the overload-avoiding unit can be connected to the mains so that electricity can be provided to the electronic device from the mains through the socket apparatus, wherein the sensing module comprises:

a consumption sensor connected to the switch module;

a logic gate controller connected to the consumption sensor;

a short-circuit sensor connected to the switch module; and an alert element connected to the short-circuit sensor on one hand and connected to the logic gate controller on the other hand.

4. The secure socket apparatus according to claim 3, wherein the alert element is a speaker.

* * * * *